US008485337B2

(12) United States Patent
Demmeler

(10) Patent No.: US 8,485,337 B2
(45) Date of Patent: Jul. 16, 2013

(54) DEVICE FOR PROCESSING BANK NOTES

(75) Inventor: Erwin Demmeler, Memmingen (DE)

(73) Assignee: Giesecke & Devrient GmbH, Munich (DE)

( * ) Notice: Subject to any disclaimer, the term of this patent is extended or adjusted under 35 U.S.C. 154(b) by 237 days.

(21) Appl. No.: 12/988,825

(22) PCT Filed: Apr. 22, 2009

(86) PCT No.: PCT/EP2009/002932
§ 371 (c)(1),
(2), (4) Date: Oct. 21, 2010

(87) PCT Pub. No.: WO2009/132794
PCT Pub. Date: Nov. 5, 2009

(65) Prior Publication Data

US 2011/0046774 A1 Feb. 24, 2011

(30) Foreign Application Priority Data

Apr. 30, 2008 (DE) ..... 10 2008 021 517

(51) Int. Cl.
*G07C 3/00* (2006.01)
*G07F 9/02* (2006.01)

(52) U.S. Cl.
USPC ..... 194/200; 194/206

(58) Field of Classification Search
USPC ..... 194/202, 206, 207; 209/534; 101/484; 399/18–21
See application file for complete search history.

(56) References Cited

U.S. PATENT DOCUMENTS

| | | | | |
|---|---|---|---|---|
| 4,533,135 | A | 8/1985 | Barker | |
| 4,583,398 | A | 4/1986 | Mitzel et al. | |
| 2003/0023342 | A1 | 1/2003 | Christl et al. | |
| 2004/0251110 | A1 | 12/2004 | Jenrick et al. | |
| 2005/0150738 | A1 * | 7/2005 | Hallowell et al. | 194/206 |
| 2007/0078560 | A1 * | 4/2007 | Jones et al. | 700/224 |
| 2008/0232082 | A1 * | 9/2008 | Martinez | 362/20 |

FOREIGN PATENT DOCUMENTS

| | | | |
|---|---|---|---|
| DE | 3242789 | C1 | 3/1984 |
| EP | 1160739 | A2 | 12/2001 |
| EP | 1246139 | A2 | 10/2002 |
| EP | 1276080 | A2 | 1/2003 |

OTHER PUBLICATIONS

International Search Report in PCT/EP2009/002932, Jul. 29, 2009.

* cited by examiner

*Primary Examiner* — Jeffrey Shapiro
(74) *Attorney, Agent, or Firm* — Bacon & Thomas, PLLC

(57) ABSTRACT

An apparatus for processing bank notes that includes an input unit for inputting bank notes, a singler for singling the input bank notes, a transport system for transporting the singled bank notes through a sensor device for checking the bank notes, a control device that evaluates signals from the sensor device, output units into which the bank notes are transported by the transport system, controlled by the control device, in dependence of the check, and detectors for monitoring the apparatus for the presence of malfunctions. The sensor device signals are evaluated by the control device for this purpose, and the control device stops the singler and the transport system in the event that the presence and/or the assumption of a malfunction is determined by the control device, wherein the control device, upon or after the stopping of the singler and of the transport system, effects an expansion of the transport system.

10 Claims, 3 Drawing Sheets

DEVICE FOR PROCESSING BANK NOTES

FIELD OF THE INVENTION

The present invention relates to an apparatus for processing bank notes.

BACKGROUND

When bank notes are processed a stack of bank notes is inserted in an input pocket, from which the bank notes are singled. The singled bank notes are transferred to a transport system, checked by sensors and allocated to output pockets in dependence of the checking. In doing so, the bank notes are checked for authenticity, soiling, damage, currency, denomination, etc. and sorted into the different output pockets in dependence thereof. Bank notes which were not recognized definitely or in an error-free fashion are sorted into a special output pocket, a reject pocket.

However, in the processing of sheet material faulty processing operations occur time and again, which are caused by disturbances such as jams or other malfunctions. To eliminate the disturbances, such as e. g. jams, extensive interference by operators is required, since for example the sheet material already processed and accounted before the malfunction has to be considered by the operator in such a fashion that the accounting which has taken place is not changed. Moreover, the operator must sort the sheet material concerned by malfunctions manually. However, such manual processing and consideration in accounting is work-intensive and very error-prone.

To avoid this it can be provided to continue operating the transport system after the occurrence of a disturbance for such a time until all bank notes disposed in the transport system have been removed from the transport system. Such a procedure and apparatus are described for example in EP 1 276 080 A2.

When disturbances occur, e g. jams, however, great loads and consequently wear or damages of the transport system or of sensitive components of the apparatus, e. g. of the sensors, can occur in the event that the transport system is continued to be operated after the occurrence of the disturbance, so as to remove all bank notes which are disposed in the transport system from the transport system. In this case the transport system is operated for a longer time after the occurrence of the disturbance. However, the danger of excessive loads and consequently wear or damages is given also in the case that the transport system is stopped immediately, since the transport system has a response delay of a certain time when it is stopped.

SUMMARY

It is therefore the object of the present invention to specify an apparatus for processing bank notes in which loads and consequently wear or damages of the transport system or of sensitive components of the apparatus, e. g. of sensors, are avoided when disturbances occur during the operation of the apparatus.

The invention therein is based on an apparatus for processing bank notes, with an input unit for inputting bank notes, a singler for singling the input bank notes, a transport system for transporting the singled bank notes through a sensor device for checking the bank notes, with a control device evaluating signals of the sensor device, output units into which, controlled by the control device, the bank notes are transported by the transport system in dependence of the checking, and detectors for monitoring the apparatus for the presence of malfunctions, wherein their signals are evaluated for this purpose by the control device, and the control device stops the singler and the transport system in the case that the control device determines the presence and/or the assumption of a malfunction, with the control device effecting a expansion of the transport system after the stopping of the singler and of the transport system.

The advantage of the invention is to be seen particularly in the fact that through the expansion of the transport system additional space is created inside the transport system, for which reason upon malfunctions, for example a jamming of bank notes, forces usually occurring do not lead to increased wear or damages of the transport system or other parts of the apparatus for processing bank notes.

In a further development it is provided that in the areas of the transport system which were expanded due to a malfunction any driven or response-delayed parts of the transport system are separated.

The advantage of the invention is to be seen particularly in that any parts of the transport system which are continued to be operated or response-delayed cannot lead to a worsening of the malfunction, e. g. a jamming of bank notes, for which reason possible damages and manifestations of wear can be further reduced.

In another further development it is provided that a section or several sections of the transport system, for which no malfunction was recognized, are continued to be operated for such a time until all bank notes have been transported by the transport system out of the section or the sections.

The advantage of this further development is to be seen in that the processing of the bank notes in the malfunction-free sections can be finished in a predetermined fashion. It is thus not required that the bank notes disposed in the undisturbed sections of the transport system must be post-processed by an operator after the elimination of the recognized malfunction in the other sections.

Further advantages of the present invention result from the dependent claims as well as the subsequent description of an embodiment with reference to figures. The subsequent description takes place with reference to an apparatus for processing bank notes. However, generally the processing of documents of value such as bank notes, checks, vouchers, etc. can take place.

DETAILED DESCRIPTION OF VARIOUS EMBODIMENTS OF THE DISCLOSURE

Figure 1:
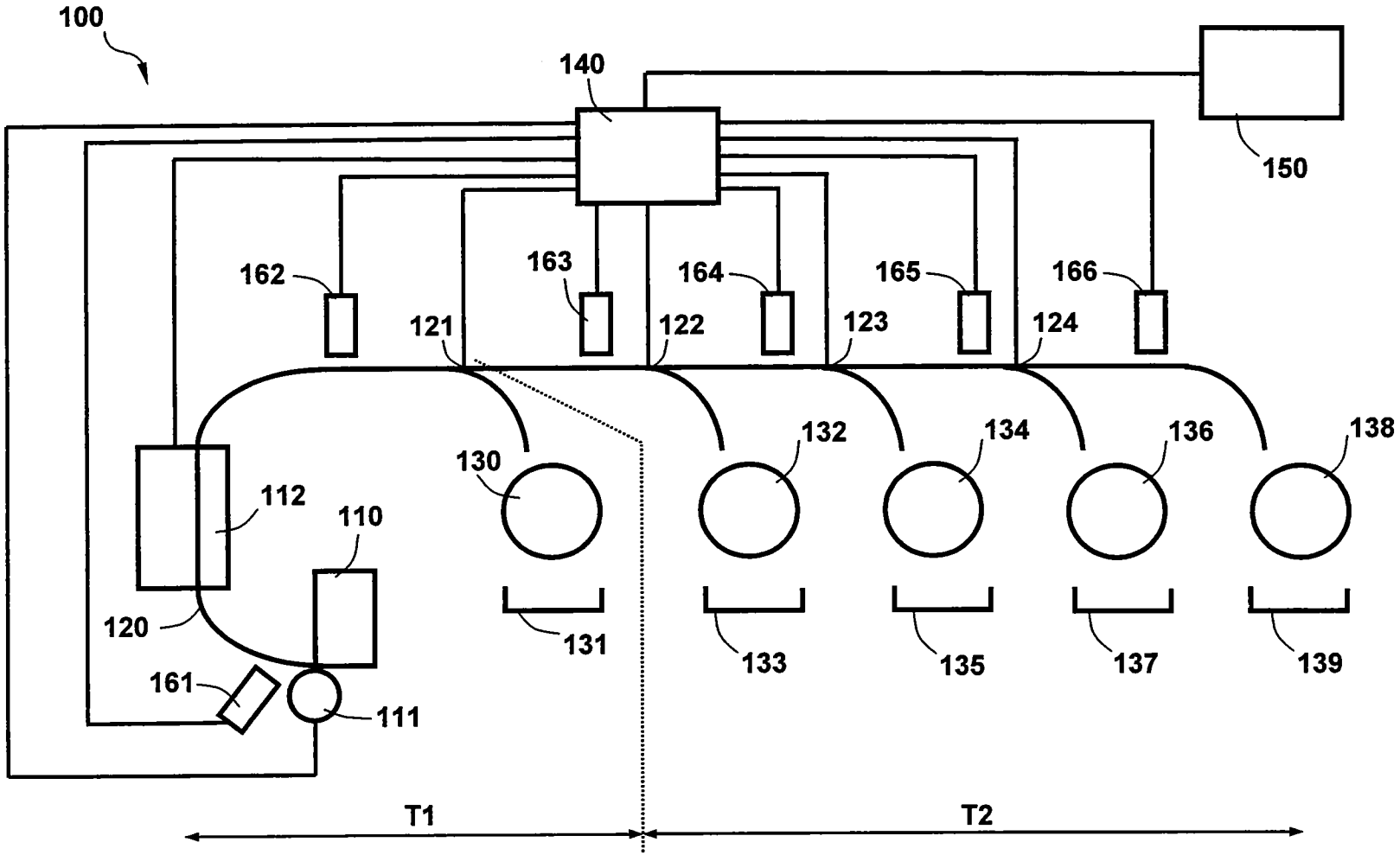
FIG. 1 a structure in principle of an apparatus for processing bank notes, and FIGS. 2-5 an embodiment of a partial area of a transport system of the apparatus of FIG. 1.

FIG. 1 shows a structure in principle of an apparatus for processing bank notes, a bank-note processing machine 100. The bank-note processing machine 100 has an input unit 110, into which the bank notes or deposits are inserted. To the input unit 110 there is connected a singler 111 which withdraws single bank notes from the input unit 110 and transfers them individually to a transport system 120. The transport system 120 transports the individual bank notes through a sensor device 112, which, by means of sensors, determines data of the bank notes, which for example permit conclusions about authenticity, state, currency, denomination, etc. The determined data of the bank notes are transferred to a control device 140, which evaluates the data and thereby controls the further flow of the bank notes through the bank-note processing machine 100. For this purpose the control device 140 acts on diverters 121 to 124, which are components of the transport system 120 and permit to store the bank notes in output units 130 to 139 in accordance with predetermined criteria. The output units 130 to 139 can for example be configured as spiral slot stackers, which stack the bank notes to be stored by means of rotating units 130, 132, 134, 136, 138 having spiral slots into deposit means 131, 133, 135, 137, 139. The operation of the bank note processing machine 100 is controlled by means of an input/output device 150 having e. g. a display and a keyboard for this purpose.

Problems occur in the processing of bank notes or deposits in the bank-note processing machine 100 when there are malfunctions such as jams, etc. To recognize disturbances the bank-note processing machine 100 can for example have detectors 161 to 166, e. g. light barriers. The light barriers 161 to 166 are arranged along the transport system 120 and enable the monitoring of the proper processing of the flow of bank notes in the bank-note processing machine 100 from the input unit 110 to the output units 130 to 139. For this purpose the signals of the light barriers 161 to 166 are evaluated by the control device 140. In the case that at the first light barrier 161 a bank note is detected at a time, the bank note, in disturbance-free operation, must be detected by the second light barrier 162 after a certain time which results from the distance between the light barriers 161 and 162 and the transport speed of the transport system 120. In case a malfunction, e. g. a jam, is detected or assumed, the control device 140 stops the further processing of the bank notes or separation cards through the bank-note processing machine 100. For this purpose in particular the singler 111 and the transport system 120 is stopped.

Alternatively, when a malfunction is detected or assumed, firstly only the singler 111 can be stopped. In this case the transport system 120 can be continued to be operated until all bank notes disposed in the transport system 120 have been removed therefrom. The bank notes are transported and stored by the transport system 120 to/in the output units 130 to 139, to which they were allocated by the control device 140 through evaluating the sensor signals. In the case that for certain bank notes in the transport system 120 no allocation is given due to the disturbance, these bank notes can be transported into a special output unit, e. g. the first output unit 130, 131. Such bank notes can be manually processed by the operator or can be input into the input unit 110 again for reprocessing.

Likewise, the transport system 120 can also be divided into two or more sections T1, T2. In this case the sections can be continued to be operated individually. This is advantageous particularly if a jam was detected or assumed in one of the sections T1 or T2 of the transport system 120. This section T1 or T2 is then stopped by the control device 140 together with the singler 111. The bank notes in the disturbance-free section T1 or T2 of the transport system 120 are transported to and stored in the output units 130, 131 or 132 to 139.

After eliminating the cause of the malfunction the processing can be continued.

In the case that a disturbance, for example a jam, is determined by the control device 140, e. g. when monitoring the light barriers 161 to 166, the singler 111 and the transport system 120 are stopped—as described above. As also described above, the transport system 120 can be stopped completely or partly. However, the transport system 120 can optionally also be continued to be operated for such a time until the bank notes present in the transport system 120 have been transported to the output pockets 130 to 139 allocated by the control device 140. To avoid wear or damages of the transport system 120 or of the sensor 112, the transport system 120 is opened in the sections in which it is stopped, concerning the complete section or parts of the section. By the opening of the transport system 120 more space is freed in the transport system 120, whereby e. g. jammed bank notes cannot cause any wear or damage, while the transport system 120 is still operated or response-delayed. In addition it can be provided that drive elements which are response-delayed or which are continued to be operated when the transport system 120 is opened are decoupled, as described in the following. Thereby occurring wear or the danger of damages is further reduced.

Figure 2:
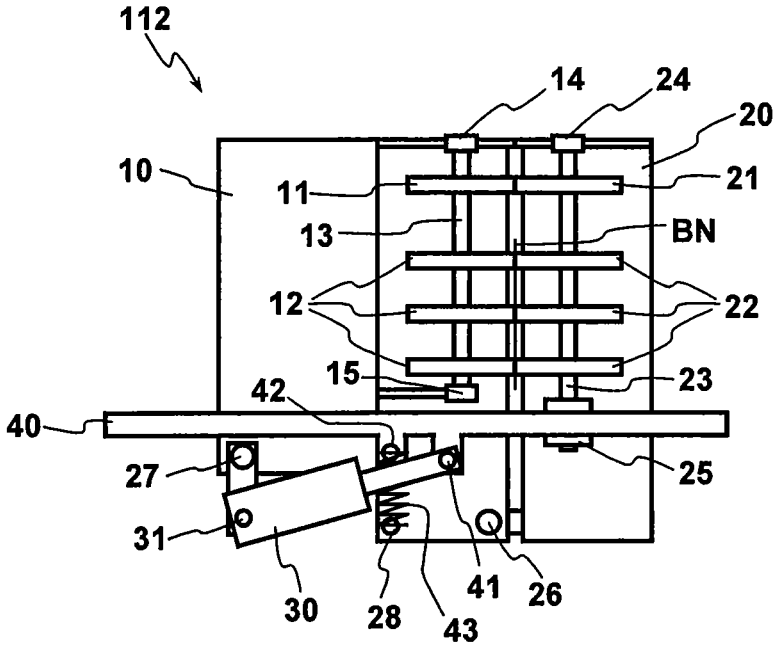
Figure 3:
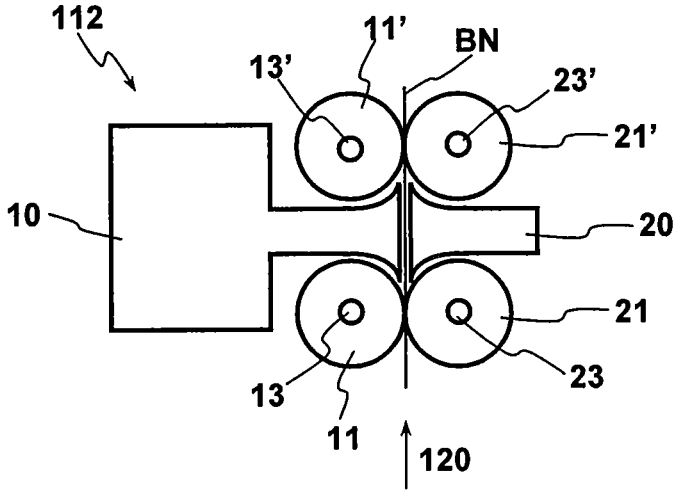

FIGS. 2 and 3 show a partial area of the transport system 120 from the area of the sensor device 112. Therein FIG. 2 shows the area of the sensor device 112 in a lateral view, in the transport direction of the transport system 120. In FIG. 3 the area of the sensor device 112 is represented turned by 90° to the transport direction, i. e. along the transport direction. A sensor consisting of two parts 10, 20 is represented by way of example. For example a first part 10 can contain an illumination, whereas a second part 20 contains a detector. The detector 20 in this case captures light coming from the illumination 10 and transmitted by the bank note BN, while the bank note BN is transported by the transport system 120 past the sensor 10, 20.

It is obvious that instead of the described sensor 10, 20 any other desired sensor or any desired combination of sensors can be used.

The sensor 10, 20 is mounted in a static frame or a static plate 40 in the apparatus for processing bank notes 100. The second part 20 of the sensor 10, 20 is mounted in a static fashion in the plate 40, whereas the first part 10 can be pivoted or tilted around an axis 26 in such a fashion that the first part 10 can be moved away from or toward the static second part 20. In the position of the two parts 10, 20 represented in FIG. 2, in which the first part 10 is maximally moved toward the static second part 20, they are disposed in an operating position in which bank notes BN are transported by the transport system 120. For pivoting the first part 10 there is provided for example a pneumatic cylinder 30, whose one end is connected 27, 31 to the first part 10. The other end of the pneumatic cylinder 30 is connected to the plate 40. When the pneumatic cylinder 30 is extended, i. e. when the transport system is closed, the greatest part of the pivoting path of the first part 10 is moved with a low pressure of the pneumatic cylinder 30 for security reasons. Only directly before reaching the final position of the first part 10, e. g. 2-3 mm, the pressure is increased so as to reach the required closing force. In the operating position represented in FIG. 2 the pneumatic cylinder 30 is extended and pressurized. To compensate the weight of the pivotal first part 10 a spring 43 is present, whose one end is connected 28 to the first part 10. The other end of the spring 43 is connected 42 to the frame 40. In the operating position represented in FIG. 2 the spring 43 is tensioned only slightly.

In the area of the sensor 10, 20 the transport system 120 is formed by roller pairs 12, 22, between which the bank notes BN are clamped. The roller pairs 12, 22 are fixed on axes 13, 23, which are supported by means of bearings 14, 15, 24, 25. Additionally drive rollers 11, 21 are fixed on the axes 13, 23. In the represented example the second axis 23 allocated to the static second part 20 of the sensor 10, 20 is driven, e. g. by means of a motor, transmission, toothed belt or the like. Via the drive roller 21 of the second axis 23 the drive roller 11 of the first axis 11 is driven. It has turned out to be advantageous to produce the drive roller 21 and the rollers 22 of the second axis 23 of a hard material, e. g. steel or aluminum, whereas it is advantageous to produce the drive roller 11 and the rollers 12 of the first axis 13 of an elastic material, e. g. rubber, in particular ethylene propylene dien rubber (EPDM).

In FIG. 3 the first and second axis 13, 23 and the two parts of the sensor 10, 20 and, lying behind when viewed in transport direction 120, further axes 13', 23' are to be seen. The further axes 13', 23' also form an axis pair, like the axes 13, 23, which also have drive rollers 11', 21' and transport rollers (not visible), so as to transport the bank notes BN. To ensure the transport of the bank notes BN, here the distance between the axes 13, 23 and the axes 13', 23', viewed in the transport direction, must be smaller than the dimension of the smallest bank note in whose direction the transport of the bank notes takes place in the transport system. In the case that the bank notes are transported in parallel to their short edges (transversally), the distance must not be greater than the width of the smallest bank note to be transported. In the case that the bank notes are transported in parallel to their long edges (lengthwise), the distance must not be greater than the length of the smallest bank note. Advantageously the distance between the axes 13, 23 and 13', 23' amounts to around half the width or length of the smallest bank note.

Figure 4:
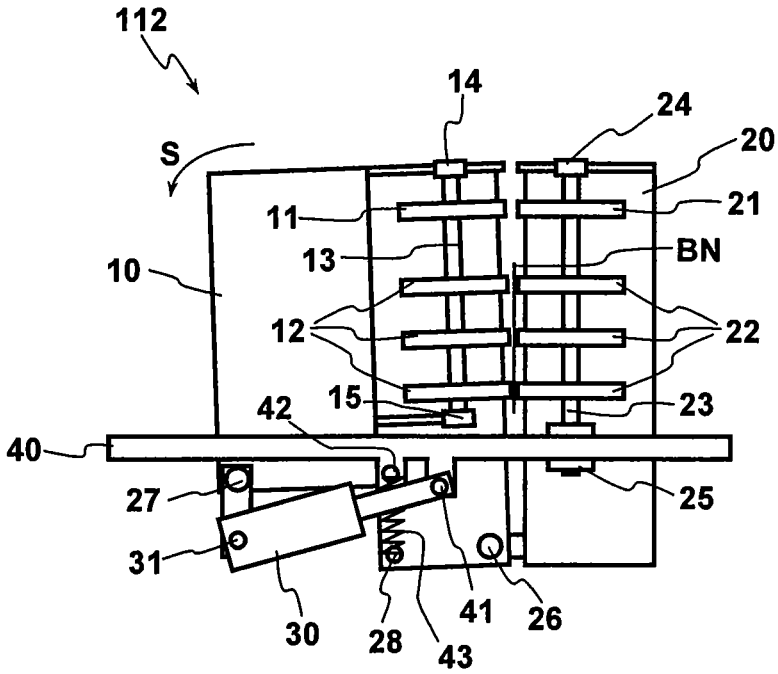

In FIG. 4 the above-described case of a disturbance in the transport system 120 is represented, in which the transport system 120 is opened. In the represented example the sensor 10, 20 is opened slightly along the transport system. For this purpose the control unit 140, upon or after detecting a disturbance, activates the pneumatic cylinder 30 or its pneumatic system not represented in greater detail, so as to open the pneumatic cylinder 30 for a short time, e. g. for 300-500 ms, and to switch it to pressureless afterwards. The first part 10 of the sensor 10, 20 is then, as described above, slightly pivoted or tilted S around the axis 26. Through this pivoting movement S of the first part 10 away from the second part 20 of the sensor 10, 20 the path of the transport system 120 lying between the two parts 10, 20 is opened slightly, thereby creating more space, e. g. for jammed bank notes. The force of the spring 43 counteracts the weight of the first part 10 of the sensor 10, 20, thereby ensuring the desired, slight opening of the path of the transport system 120. Additionally the drive wheel 21 fixed on the driven second axis 23 is separated from the drive wheel of the first axis 11, so that the transport rollers 12 of the first axis 11 are no longer driven. A longer operation of the transport system 120 or a delayed response of the drive of the second axis 23 as described above, can consequently not lead to increased wear, since the wear-sensitive rollers 11, 12 of the first axis 13 are no longer driven. Also the bank notes BN disposed in the area of the sensor 10, 20 are not damaged or further jammed, since only the rollers 22 of the second axis 23 are driven or response-delayed and the rollers 22 consist of hard and smooth material, so that they alone do not exert any substantial forces on the bank notes BN. However, since the sensor 10, 20 is opened only slightly, the bank notes BN cannot leave the area of the transport system 120 in an uncontrolled fashion and additionally remain in the area of the sensor 10, 20.

Figure 5:
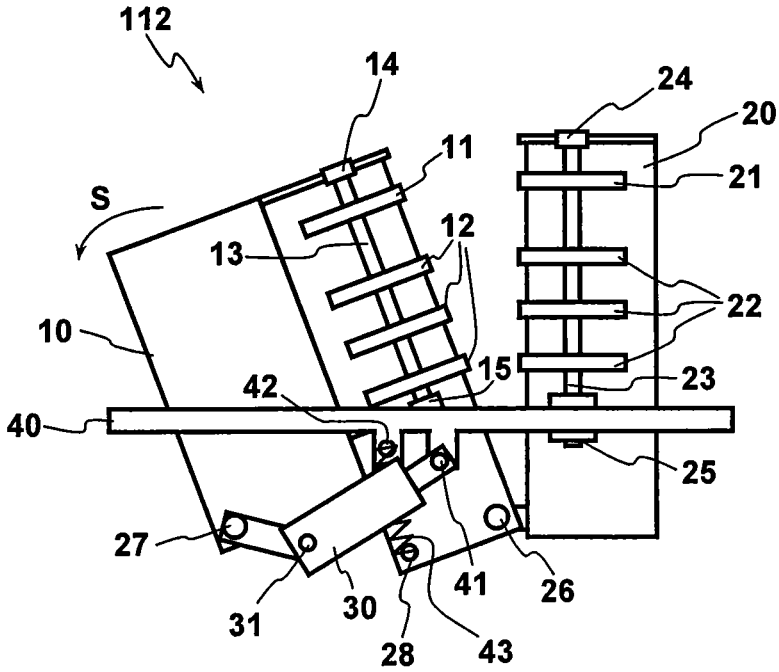

In FIG. 5 shows the sensor 10, 20 with opened path of the transport system 120, which results between the two parts 10, 20 of the sensor 10, 20. In this case the pneumatic cylinder 30 is refracted and the weight of the pivoted first part 10 of the sensor 10, 20 is compensated by the stretched spring 43. Through the opening of the path of the transport system 120 bank notes, which are jammed e. g. in the area of the sensor 10, 20, can be removed. For this purpose it can be provided that the control device 140 activates the pneumatic system so as to retract the pneumatic cylinder 30 after the complete transport system 120 or the section T1 containing the sensor 10, 20 of the transport system 120 has completely come to a standstill. Likewise the opening of the path can be prompted by the operator.

Deviating from the above description, according to which the complete transport system 120 is opened or expanded, so as to create space in particular for jammed bank notes and to avoid the damaging of parts of the apparatus for processing bank notes, also individual sections or certain partial areas of the transport system 120 can be opened. Advantageously the sections or partial areas of the transport system 120 are opened for which a malfunction was determined.

The opening of the transport system 120 was described before in connection with the pivoting or tilting of a part 10 of the transport system 120. It is obvious that also other measures are suitable, as long as these create additional space in the transport system 120 and/or decouple driven parts of the transport system 120. For example parts of the transport system can be shifted in parallel by means of linear guides so as to create additional space, e. g. for jammed bank notes.

Varying from the above-described pneumatic opening of the transport system 120 or of parts thereof, an opening of the transport system 120 can also be achieved by other means. For example hydraulically or electro-mechanically working means or combinations thereof can be used.

The invention claimed is:

1. An apparatus for processing bank notes, comprising:

an input unit for inputting bank notes;

a singler for singling input bank notes;

a sensor device configured to check the singled bank notes and produce sensor signals indicating checking results;

a transport system for transporting the singled bank notes through the sensor device, said transport system configured to expand or widen to create a space;

a control device arranged to receive and evaluate the sensor signals;

output units into which the bank notes are transported by the transport system, said transport system controlled by the control device in dependence on the checking results;

detectors for monitoring the apparatus for a presence and/or assumption of malfunctions and configured to produce detection signals;

wherein the detection signals are evaluated by the control device, and wherein the control device is configured to stop the singler and the transport system in the event that the presence and/or the assumption of a malfunction is determined by the control device; and upon or after stopping the singler and the transport system, the control device is configured to send a control signal to expand or widen the transport system.

2. The apparatus according to claim 1, wherein upon expansion, the transport system is opened slightly.

3. The apparatus according to claim 1, wherein upon expansion, the transport system is expanded along its complete length.

4. The apparatus according to claim 1, wherein the transport system, upon expansion, is expanded along one or several sections or partial areas, in which a malfunction was determined.

5. The apparatus according to claim 1, wherein, upon expansion of the transport system, the expanded parts are separated from driven or response-delayed parts of the transport system.

6. The apparatus according to claim 1, wherein the transport system or parts thereof comprises two parts, with one part being supported in a movable fashion relative to the other part.

7. The apparatus according to claim 6, wherein the movably supported part of the transport system is supported so that it can be pivoted away from the other part.

8. The apparatus according to claim 6, including a pneumatic cylinder that is arranged to move the movable part of the transport system.

9. The apparatus according to claim 6, including a spring arranged to compensate for the weight of the movable part.

10. The apparatus according to claim 1, wherein one or several sections of the transport system are arranged to be continuously operated for such a time until all bank notes have been transported by the transport system out of the respective section or sections upon or after stopping of the singler.

* * * * *